US006485019B1

(12) United States Patent
Braunlich et al.

(10) Patent No.: US 6,485,019 B1
(45) Date of Patent: Nov. 26, 2002

(54) MULTILEVEL CHANGING GAME

(76) Inventors: Tom Braunlich, One Harbor Ct. #19B, Portsmouth, VA (US) 23704; Rollie Tesh, One Harbor Ct. #21G, Portsmouth, VA (US) 23704; Jim Winslow, 18 Maple Ter., Maplewood, NJ (US) 07040

( * ) Notice: Subject to any disclaimer, the term of this patent is extended or adjusted under 35 U.S.C. 154(b) by 0 days.

(21) Appl. No.: 09/712,188

(22) Filed: Nov. 15, 2000

(51) Int. Cl.[7] ..... A63F 3/00
(52) U.S. Cl. ..... 273/284; 273/287; 273/242
(58) Field of Search ..... 273/283, 284, 273/285, 286, 287, 275, 236, 241, 242

(56) References Cited

U.S. PATENT DOCUMENTS 3,031,193 A * 4/1962 Chapman
3,206,887 A * 9/1965 Eyler
3,758,693 A * 9/1973 Ebert
4,210,336 A * 7/1980 Williamson
4,350,343 A * 9/1982 Salazar
4,365,438 A * 12/1982 Nelson
5,255,923 A * 10/1993 Bennett
5,356,155 A * 10/1994 Gross

* cited by examiner

*Primary Examiner*—Benjamin H. Layno
*Assistant Examiner*—V K Mendiratta
(74) *Attorney, Agent, or Firm*—Reed Smith LLP

(57) ABSTRACT

Multiple playing levels in a stacked multilevel game, appear with unique indicia on different playing levels, and these indicia provide different pathways of movement for game pieces between multiple apertures which extend through the multiple playing levels. By switching the playing level relative to the game pieces, the situations and events faced by different players is altered. In a "book" format, switching playing levels is achieved simply by turning the pages forward or backward. Other formats include a "map" style, wherein different playing levels are secured to adjacent levels by folds in the game board, and a "stacked layer" style, wherein a plurality of playing levels are achieved by stacked layers.

9 Claims, 4 Drawing Sheets

MULTILEVEL CHANGING GAME

BACKGROUND OF THE INVENTION

1. Field of the Invention

The invention generally relates to games, and, more particularly to board games which allow multiple level play.

2. Description of the Prior Art

Board games typically include a board, one or more game pieces which are used on the board with different players or teams of players generally having different game pieces, and indicia printed on the board defining spaces, functions, travel paths or other information. Movement of game pieces is often controlled by rolling dice, using a spinner, or by using instructional cards. Alternatively, in many strategy games such as chess, movement is simply decided by taking alternating turns. Each game has unique rules which define the goal of the game, how and what actions can be taken by the various players, and how certain events proceed, such as the start and finish of the game. The rules vary widely from game to game, and, indeed, the rules are the very essence of the game, since many different types of games are readily amenable to play on a board format.

Often, the board game is designed to have all pieces fit within an oblong rectangular box. The board itself can be sized to fit within the box as a unitary flat surface; however, to accommodate greater playing options, the board is often folded in half or in thirds or in other manners which will allow a larger sized playing surface to be achieved.

In U.S. Pat. No. 5,255,923 to Bennett, a board game is described which has apertures which extend through one or more hinged play sections. The design allows play to be extended to different sections of an extended board by having pieces pass through an aperture. However, the Bennett concept is not directed to and does not allow for multilevel play. Rather, it is oriented only to two dimensional play with extended path routes for game pieces, and it does not allow free movement forward and reverse.

There are few games which allow multilevel games to be played. Typically, these games are generally focused on high level strategic endeavors such as three dimensional chess or three dimensional connect four.

SUMMARY OF THE INVENTION

It is an object of this invention to provide a new and improved game, which is akin to a board game, but which will allows play to proceed on multiple levels by allowing one or more playing levels to be switched relative to game pieces maintained in apertures which extend through the multiple stacked playing levels.

According to the invention, a plurality of playing levels, each with unique indicia thereon, are stacked on top of each other. A plurality of apertures extend through the multiple stacked playing levels. During play, game pieces travel between apertures according to the rules of the game being played. Interconnections between apertures on different levels will vary according to the indicia thereon. Thus, the game board allows for playing conditions to vary by switching between playing levels, with the relative positions of the game pieces remaining stationary during switching.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS OF THE INVENTION

Figure 1:
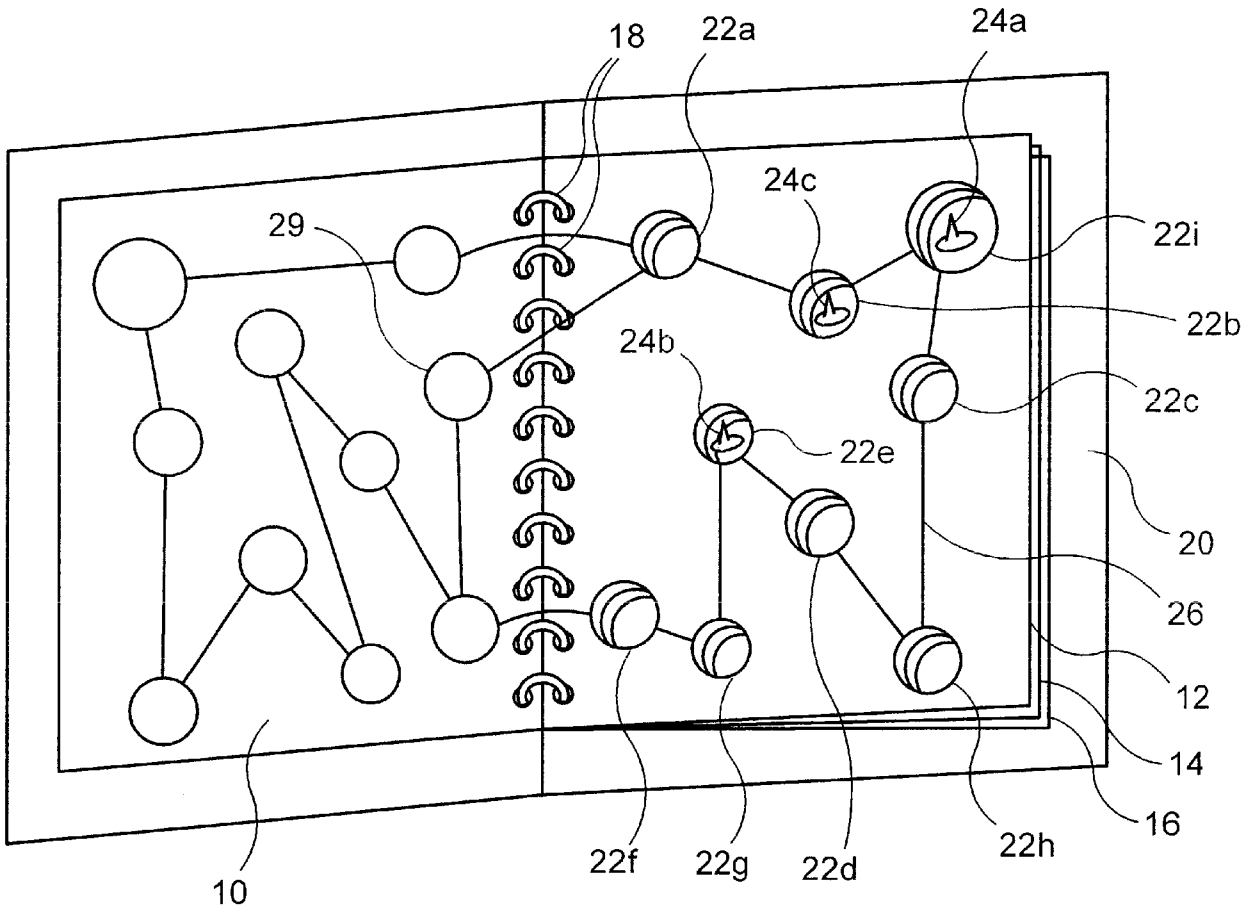
FIG. 1 is a top perspective view of the game according to a "book" style embodiment of the invention, where a plurality of apertures extend through the leaves of the book, and where each page of the book has unique indicia thereon.

FIG. 1 shows a "book" embodiment of the invention. The "book" embodiment includes a plurality of leaves 10, 12, 14, 16, etc., which are bound by binder rings 18 within a book jacket housing 20. The leaves 10, 12, 14, and 16 can be constructed of paper, heavy construction board, cardboard, or other suitable materials. The book jacket housing 20 can be constructed of cardboard, leather, or other suitable material. While a plurality of rings 18 are shown, it is clear that fewer rings or greater numbers of rings can be used, and that alternative binder configurations might be used. The function of the rings 18 is to serve as a switching means whereby one or more leaves 10, 12, 14, and 16 can be flipped from one side of the book to the other.

Of peculiar distinction for this invention is the inclusion of apertures 22*a–i* which extend through the leaves 10, 12, 14, and 16. In addition, the invention contemplates that different indicia will be positioned on each page in the book (a "page" being defined as one side of a leave in the book).

The game design of this invention allows multiple level strategic play. A plurality of game pieces 24*a–c* are used in the new game design of this invention. Movement of game pieces 24*a–c* can be achieved using conventional mechanisms such as rolling dice, using a spinner, drawing cards, or simply taking turns. Movement on any one playing level or "page" will be defined by the indicia thereon. For example, various pathways 26 between apertures 22*a–i* are defined on each page, and the movement of the players will be along these pathways for that page.

Figure 2:
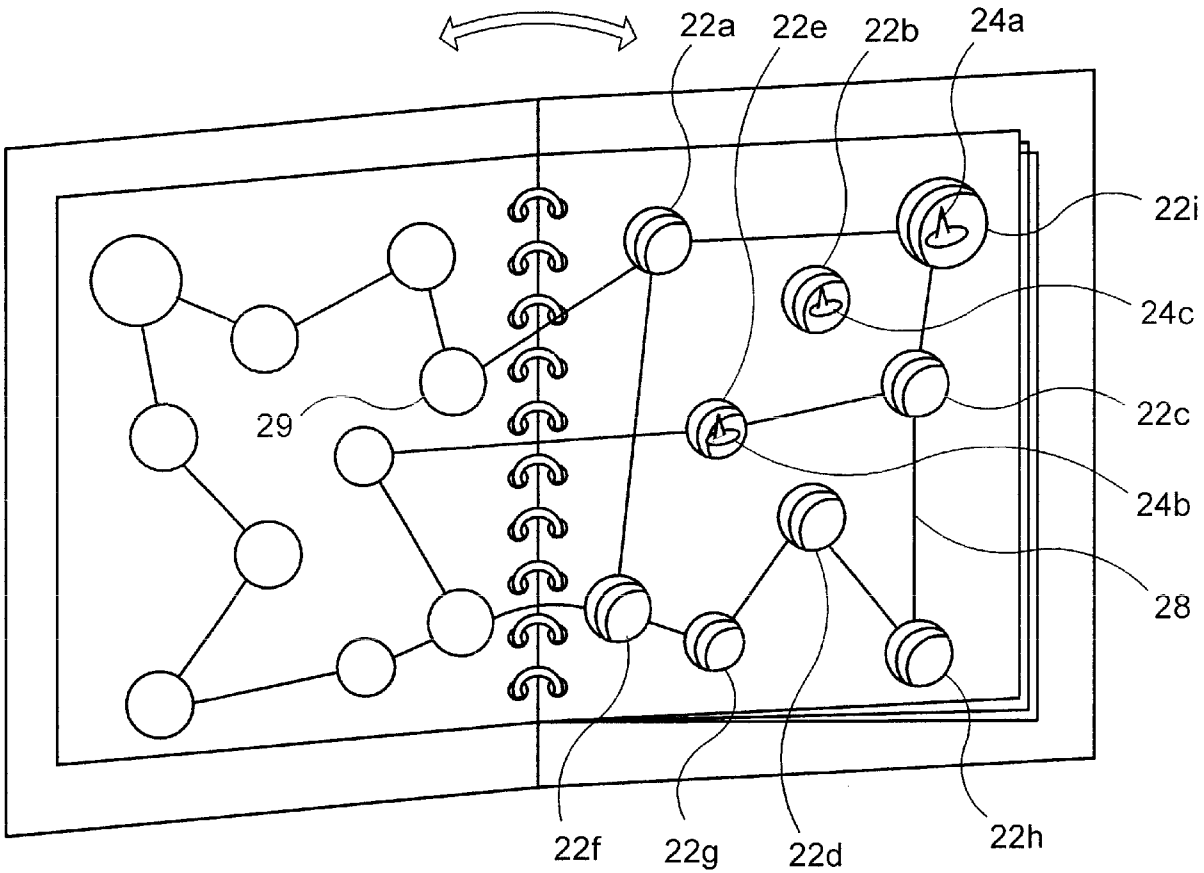
FIG. 2 is a top perspective view of the game shown in FIG. 1 where one of the leaves has been moved relative to the lower leaves, revealing a change in the indicia on the different pages of the game.

However, by turning the page, as is best shown in FIG. 2, the indicia, which includes alternative pathways 28, changes and alters the situations and events faced by the various players. For example, by contrasting FIGS. 1 and 2, it can be seen that game pieces 24*a* and 24*b*, which are respectively in apertures 22*i* and 22*e*, are closer together on new pathway 28. In a sense, 24*a* and 24*b* have past through a warp in the playing field. Conversely, playing piece 24*c*, which is in aperture 24*c*, becomes "stuck" in FIG. 2, since it no longer is on any pathway.

Thus, it can be seen that an important feature of this invention is to have a game design which allows moving various playing levels relative to game pieces in an orderly fashion. That is, while the playing pieces 24*a–c* remain in the apertures 22*a–i*, forward or reverse movement of the leaves 10, 12, 14, and 16, causes the pieces to have different movement possibilities based on the indicia on the pages. Play can continue on both facing pages as is shown by the pathways 26 and 28 in FIGS. 1 and 2. Alternatively, a backside of any or all of the leaves 10, 12, 14, and 16 could be "inactive", with play only proceeding on the "active" side which has indicia. Furthermore, variations can be built into the game by having different sized apertures (e.g., 22*i* being larger than 22*h*) allowing for larger numbers of game pieces 24*a–c*, or symbolizing different aspects of the game (e.g., start or end). In addition, the game could be varied such that some of the apertures do not extend through all of the leaves 10, 12, 14, and 16. This is illustrated by aperture 29 on page 10 having no corresponding aperture on page 12. In this way, certain pages would not be accessible when any player's game piece 24*a–c* is on a page where the aperture does not extend therethrough.

Many different types of games may be played using the game design of this invention. Of course, these games will depend on whatever rules are developed. For example, you may have a game based on a specific genre, such as the Wizard of Oz. In this example, one page might be munchkinland, while another page might be Emerald City. When a player turns the page during play, he or she effectively moves himself or herself, as well as all the other players, from the confines of munchkinland to Emerald City. Later moves by other players might return all players back to munchkinland. Of course, space genres, spy genres, and virtually any other type of situational game can be advantegously played on the inventive game design because it introduces the multilevel strategic planning that would come from being able to warp between different situations or events by altering the playing level of the multilevel stacked playing levels relative to the game pieces 24*a–c*.

Figure 3:
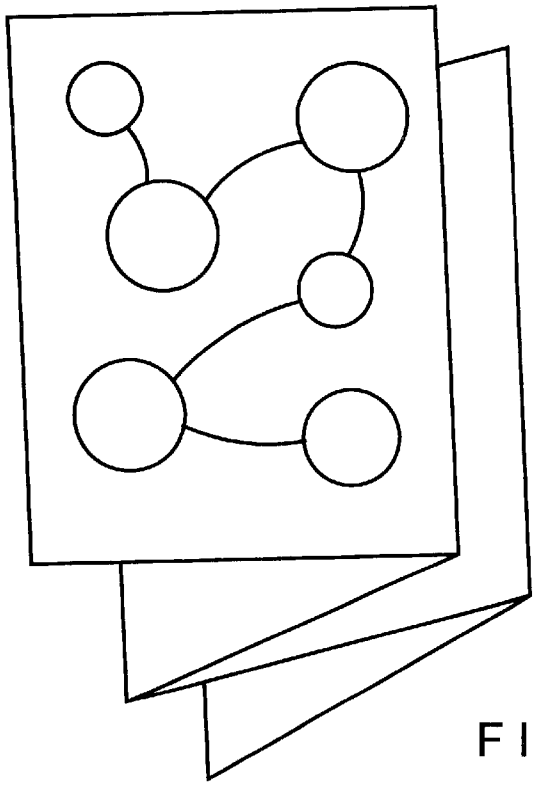
FIG. 3 is a top perspective view of a game according to a "map" style embodiment of the invention, where a plurality of apertures extend through different sections of the map, and where each section of the map has unique indicia thereon.
Figure 4:
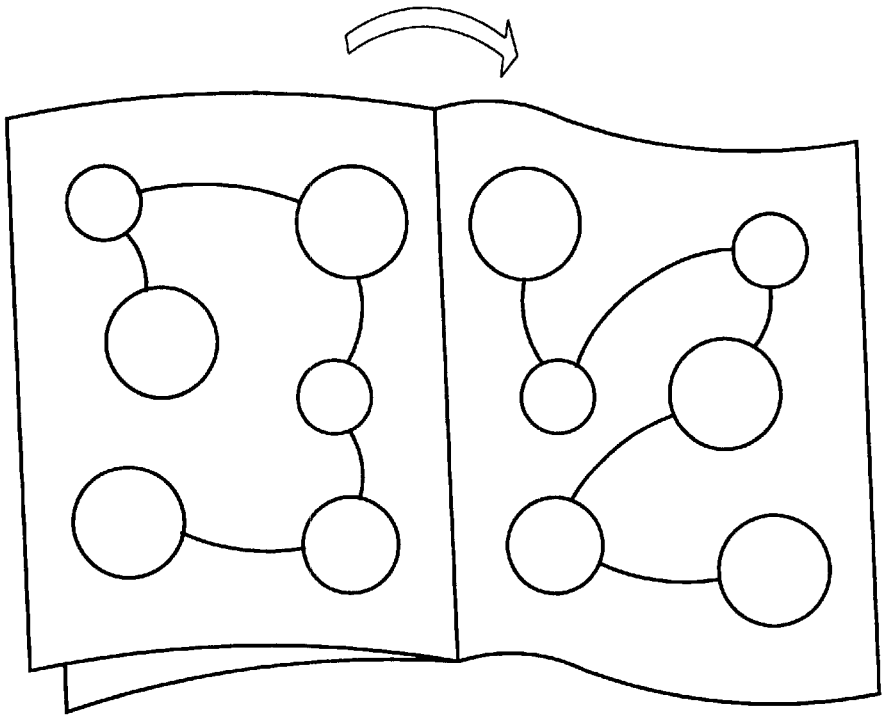
FIG. 4 is a top perspective view of the game shown in FIG. 3 where one of the sections has been opened to an inactive position to reveal a new section on which play will continue.

The multilevel concept of this game is not confined simply to a "book" configuration. For example, FIGS. 3 and 4 illustrate a "map" configuration where different levels are secured to adjacent levels by folds 32. Shifting between levels simply requires opening the "map" configuration along the folds 32 as shown in FIG. 4.

Figure 5:
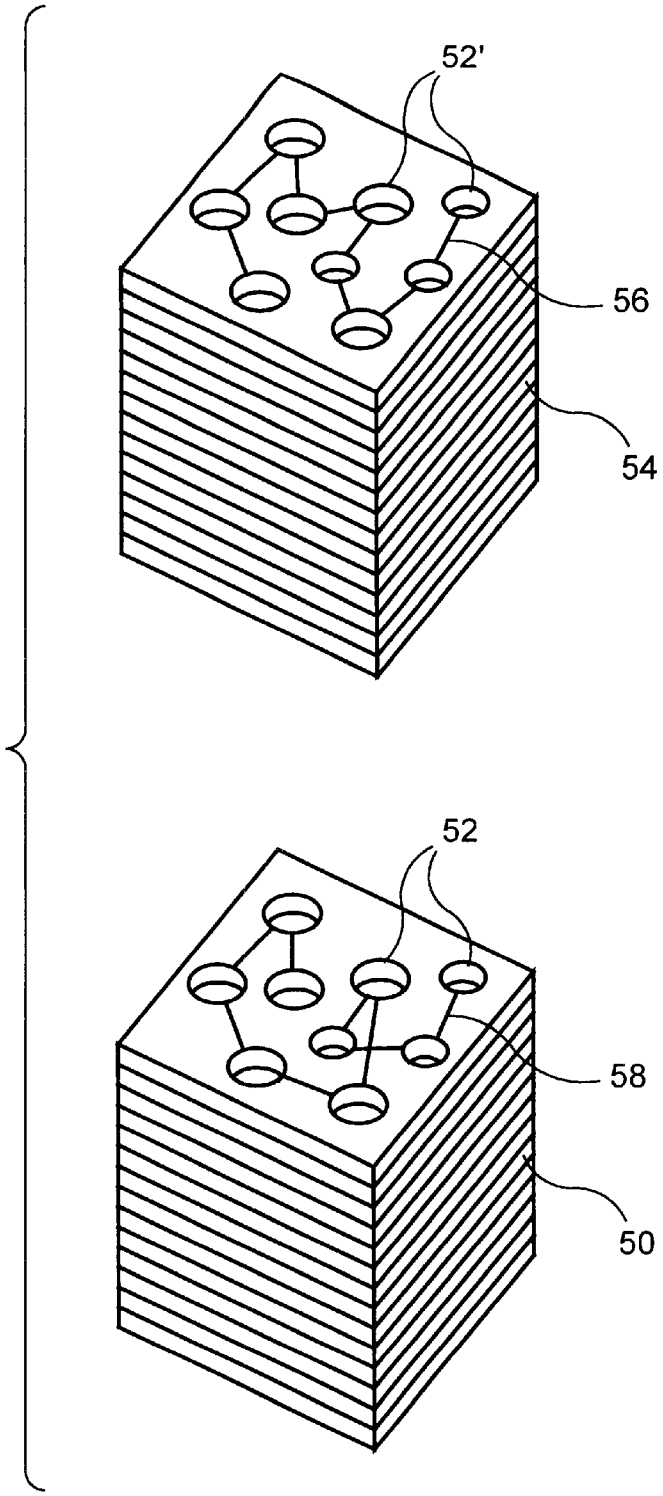
FIG. 5 is an isometric view of game according to a third embodiment of the invention, where a plurality of apertures extend through stacked layers, and layers can be added or subtracted to change the playing events and conditions.

A very simple design for this invention would be simply to have stacked layers which can be switched by lifting them up and setting them aside. This is shown in FIG. 5 where a first stack 50 has a plurality of holes 52 therethrough. A second stack 54 also has holes 52' therethrough. The patterns 56 and 58 on the top of each stack are different, and define different pathways game pieces would travel. One can change the patterns by adding and/or subtracting playing levels from the stack (e.g., stack 54 can be added to stack 52, and, likewise, stack 54 can be removed from atop stack 52). An advantage of the stacked layer design as well as the book format, is that additional "chapters" could be added at a later time. Specifically, new pages could be obtained separately from the basic game, and these new pages could be added to allow further multilevel variations in play (this being akin to issuing new playing cards for use in a quiz game).

While the invention has been described in terms of its preferred embodiments, those of skill in the art will recognize that the invention can be practiced with considerable variation with the scope of the appended claims.

We claim:

1. A game, comprising multiple stacked playing levels, each playing level having indicia thereon which pertain to different game situations or events;

each playing level having a plurality of apertures, each aperture of which extend through one or more of said multiple stacked playing levels, wherein said indicia on each playing level display interconnections with at least a portion of said plurality of apertures which extend through said playing level;

a plurality of game pieces which fit within said apertures; and means for switching between playing levels of said multiple stacked playing levels while maintaining said game pieces within said apertures, said means for switching permitting both adding of playing levels on top of a specified playing level and removing of playing levels from above said specified playing level.

2. The game of claim 1 wherein at least two of said plurality of apertures extend through different numbers of playing levels.

3. The game of claim 1 wherein said means for switching comprises binder that binds one edge of each of said multiple stacked playing levels and permits rotation of each of said playing levels about said binder from a first "play" position to a second "inactive" position, whereby said game resembles a book with said multiple stacked playing levels being analogous to pages in said book.

4. The game of claim 3 wherein said multiple playing levels are paper.

5. The game of claim 3 wherein said multiple playing levels are card board.

6. The game of claim 1 wherein said means for switching comprises folded edges of adjacent playing levels in said multiple stacked playing levels, whereby said game resembles a map with said multiple stacked playing levels being interconnected by said folded edges and movement between specified levels is achieved in a fashion similar to opening and closing a map.

7. The game of claim 1 wherein said means for switching includes a means of changing a number of playing levels in said multiple stacked playing levels.

8. The game of claim 7 wherein said means of changing said number of playing levels adds or subtracts a specified number of playing levels to said multiple stacked playing levels.

9. The game of claim 1 wherein said means for switching subtracts playing levels when said game pieces traverse from a first position at or near a top of said multiple stacked playing levels to a second position at or near a bottom of said multiple stacked playing levels, and adds playing levels to said top of said multiple stacked playing levels when said game pieces traverse in a reverse direction.

* * * * *